US007936161B2

(12) United States Patent
Nakagawa

(10) Patent No.: US 7,936,161 B2
(45) Date of Patent: May 3, 2011

(54) BIAS CIRCUIT HAVING SECOND CURRENT PATH TO BANDGAP REFERENCE DURING POWER-ON

(75) Inventor: Kurao Nakagawa, Shiga (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 236 days.

(21) Appl. No.: 12/155,712

(22) Filed: Jun. 9, 2008

(65) Prior Publication Data

US 2008/0309309 A1 Dec. 18, 2008

(30) Foreign Application Priority Data

Jun. 15, 2007 (JP) ..... 2007-158479

(51) Int. Cl.
*G05F 3/16* (2006.01)
*G05F 3/20* (2006.01)

(52) U.S. Cl. ..... 323/313; 323/314; 323/315; 323/316; 327/538; 327/539

(58) Field of Classification Search ..... 323/313, 323/314, 315, 316; 327/538, 539, 540
See application file for complete search history.

(56) References Cited

U.S. PATENT DOCUMENTS

| | | | | |
|---|---|---|---|---|
| 5,506,496 | A * | 4/1996 | Wrathall et al. | 323/316 |
| 6,344,770 | B1 * | 2/2002 | Zha et al. | 327/539 |
| 6,445,167 | B1 * | 9/2002 | Marty | 323/280 |
| 6,617,833 | B1 * | 9/2003 | Xi | 323/282 |
| 6,930,538 | B2 * | 8/2005 | Chatal | 327/539 |
| 7,038,440 | B2 * | 5/2006 | Cali' et al. | 323/313 |
| 2003/0201822 | A1 * | 10/2003 | Kang et al. | 327/539 |
| 2005/0151526 | A1 * | 7/2005 | Cali et al. | 323/312 |
| 2006/0038550 | A1 * | 2/2006 | Nazarian | 323/315 |
| 2007/0040602 | A1 * | 2/2007 | Lin | 327/541 |
| 2007/0146059 | A1 * | 6/2007 | Jo | 327/539 |
| 2008/0157746 | A1 * | 7/2008 | Chen | 323/313 |
| 2008/0231248 | A1 * | 9/2008 | Hung | 323/313 |

* cited by examiner

*Primary Examiner* — Bao Q Vu
(74) *Attorney, Agent, or Firm* — McGinn IP Law Group, PLLC

(57) ABSTRACT

In a conventional bias circuit, as a power supply voltage increases, a current supplied to a bandgap reference becomes unstable due to a fluctuation of the power supply voltage, which makes it impossible for the bias circuit to perform stable bias operations in some cases. A bias circuit of the present invention has a bandgap reference, and includes a first current path supplying a drive current to the bandgap reference, and a second current path supplying a current to the bandgap reference for a predetermined period of time after power-on.

17 Claims, 5 Drawing Sheets

BIAS CIRCUIT HAVING SECOND CURRENT PATH TO BANDGAP REFERENCE DURING POWER-ON

BACKGROUND OF THE INVENTION

1. Field of the Invention

The present invention relates to a bias circuit, and more particularly, to a bias circuit having a bandgap reference.

2. Description of Related Art

To stabilize power supply variation characteristics of a semiconductor integrated circuit, it is necessary to provide a constant current bias and a low temperature coefficient reference voltage which are not affected by temperature in the integrated circuit. For this reason, there has heretofore been widely used a bias circuit having a function of keeping a circuit current substantially constant independently of a power supply applied voltage, by use of a constant current source employing a bandgap reference (hereinafter, referred to as "BGR"). Further, as a bias circuit of this type, there is used a bias circuit having a current supply path for the BGR to be ready for a stable operation in a short period of time from a rise time during power-on.

FIG. 4 shows a configuration example of a bias circuit 40 of a related art, and FIG. 5 shows an operation waveform of the bias circuit 40. The bias circuit 40 includes a BGR 102 and a current path 100. The BGR 102 supplies a bias to an internal circuit of a semiconductor integrated circuit. The current path 100 supplies a current for causing the BGR 102 to operate. The current path 100 includes devices 105 and 106 and a resistor element R101. The device 106 (corresponding to PMOS transistor Tr106 in this case) is current mirror connected to a transistor provided in the internal circuit of the semiconductor integrated circuit. The device 105 (corresponding to bipolar NPN transistor Tr105 in this case) is connected in parallel with the resistor element R101.

As a power supply voltage, which is an output voltage from a power supply voltage terminal 107, gradually increases from 0 V during a time period ton_d, a current I101, which is supplied to the BGR 102 from the PMOS transistor Tr106 through the resistor element R101 in the current path 100, also increases. Then, the current I101 flows in an amount necessary and sufficient for starting the BGR 102, and the BGR 102 is started at a timing ton_s. The BGR 102 performs a constant current operation, so a transistor device 103 (corresponding to bipolar NPN transistor Tr103 in this case), which is current mirror connected to the BGR 102, also performs the constant current operation. As a result, a constant voltage generation circuit (hereinafter, referred as "VREG") 104, which is connected between the power supply voltage terminal 107 and a collector of the transistor Tr103, operates. Accordingly, a constant voltage is output to a node 109, thereby turning on the transistor Tr105.

From that time, most of the current supplied to the BGR 102 is supplied as an emitter current I105 of the transistor Tr105, and a voltage at a node 108, which is a current supply point for the BGR 102, is also stabilized by a constant voltage output of the VREG 104. As a result, the BGR 102 is not affected by a voltage fluctuation during a time period for the BGR 102 to reach a final voltage (30 V, for example) from a start time in a time period ton_cons, and operates as a constant current consumption circuit. Therefore, a current I106 flowing through the transistor Tr106 is kept constant, thereby enabling a constant current bias operation for the internal circuit of the semiconductor integrated circuit.

However, in the bias circuit of the related art, during the time period ton_cons, as the power supply voltage increases, a voltage across both ends of the resistor element R101 also increases. As a result, the current I101 flowing through the resistor element R101 also increases. Accordingly, contrary to the increase in current with an increase of the power supply voltage, the current I105 flowing through the transistor Tr105 decreases. Further, when the power supply voltage exceeds the final voltage (30 V, for example) and further increases (to 40 V, for example), the current I105 becomes 0 A at a time ton_f, and the transistor Tr105 is turned off, whereby the node 108, which is kept at the constant voltage during the time period ton_cons, becomes incapable of performing the constant voltage operation. Accordingly, after the time ton_f, the current of the resistor element R101 continues to increase and the current supplied to the BGR 102 also increases. In other words, when the node 108 is not kept at the constant voltage, the BGR 102 shifts the operation from the constant current operation to a fluctuation operation, with the result that the bias circuit 40 itself becomes unstable due to the fluctuation of the power supply.

To solve the above-mentioned problems, there can be employed a method in which a resistance value of the resistor element R101 is set as large as possible, and an amount of a current (and current change amount) flowing through the resistor element R101 with an increase of the power supply voltage, is reduced, to thereby make the time period ton_cons longer. However, in this case, a current supply period (time period ton_d) for starting the BGR 102 also becomes longer, whereby it takes long time to start the operation for stabilizing the bias circuit 40. In other words, the stable operation of the bias circuit in a wide range of an applied voltage of the power supply voltage is incompatible with the reduction in time for stabilization during the starting operation.

As described above, in the related art, with the increase of the power supply voltage, the bias circuit becomes unstable for a long time period time due to the fluctuation of the power supply in some cases.

SUMMARY

In one embodiment of the present invention, there is provided a bias circuit having a bandgap reference, including: a first current path supplying a drive current to the bandgap reference; and a second current path supplying a current to the bandgap reference for a predetermined period of time after power-on.

In the bias circuit according to the present invention, after power-on, for example, even when a value of a current flowing through the first current path to drive the bandgap reference is small, the second current path is capable of supplying the drive current for the predetermined period of time, whereby a time for starting a constant voltage output operation of the bandgap reference is prevented from being longer, and a stable bias operation can be achieved even when a power supply voltage increases.

With the bias circuit according to the present invention, the stable bias operation can be achieved in a short period of time after power-on, and the bias circuit is prevented from being unstable for a longer period of time due to a power supply fluctuation.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION OF THE PREFERRED EMBODIMENTS

The invention will now be described herein with reference to illustrative embodiments. Those skilled in the art will recognize that many alternative embodiments can be accomplished using the teachings of the present invention and that the invention is not limited to the embodiments illustrated for explanatory purposes.

Embodiments

Figure 1:
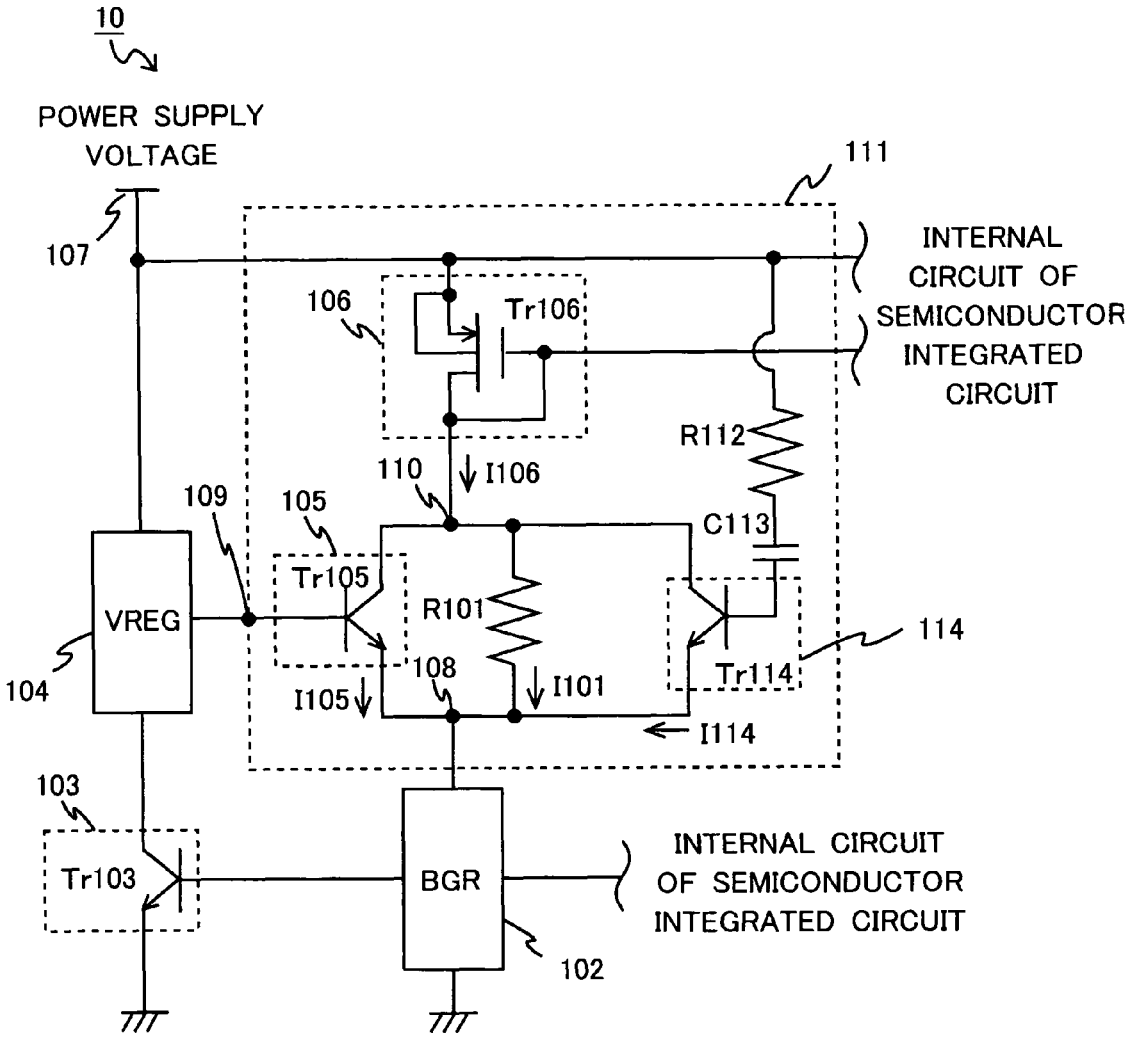
FIG. 1 shows a bias circuit according to an embodiment of the present invention.

Hereinafter, exemplary embodiments to which the present invention is applied will be described in detail with reference to the drawings. FIG. 1 is a circuit diagram showing a bias circuit according to a first embodiment of the present invention. A bias circuit 10 includes a current path 111, a bandgap reference 102 (hereinafter, referred to as "102"), a device 103, a constant voltage generation circuit 104 (hereinafter, referred to as "VREG 104"), and a power supply voltage terminal 107. The device 103 includes a bipolar NPN transistor Tr103. Hereinafter, the device 103 is treated as the bipolar NPN transistor Tr103.

The current path 111 includes a device 106, a resistor element R101 (for example, first resistor element), a device 105, a resistor element R112 (for example, a second resistor element), a capacitor element C113, and a device 114.

The device 106 includes a PMOS transistor Tr106. Hereinafter, the device 106 is treated as the PMOS transistor Tr106. The device 105 includes a bipolar NPN transistor Tr105 (for example, first transistor). Hereinafter, the device 105 is treated as the bipolar NPN transistor Tr105. The device 114 includes a bipolar NPN transistor Tr114 (for example, second transistor). Hereinafter, the device 114 is treated as the bipolar NPN transistor Tr114.

In this case, it is assumed that the resistor element R101 and the device 105 (transistor Tr105) serve as a first current path, and that the device 114 (transistor Tr114) serves as a second current path. In FIG. 1, the devices 103, 105, and 106 are each configured of a single bipolar transistor or a single MOS transistor, but may be configured of a plurality of transistors. Further, the bipolar transistor may be replaced with the MOS transistor, or the MOS transistor may be replaced with the bipolar transistor. The configuration of each transistor may vary without affecting the basic performance of each transistor.

In this case, the PMOS transistor Tr106 has a source connected to the power supply voltage terminal 107, and a gate and a drain connected to a node 110. In the PMOS transistor Tr106, a source-drain current is adjusted to be 10 μA, for example. Further, the PMOS transistor Tr106 is current mirror connected to a transistor provided in an internal circuit of a semiconductor integrated circuit (not shown). The resistor element R101 is connected between the node 110 and the node 108. The transistor Tr105 has a collector connected to the node 110, an emitter connected to the node 108, and a base connected to a constant voltage output terminal of the VREG 104. The resistor element R112 is connected between the power supply voltage terminal 107 and the capacitor element C113. The capacitor element C113 is connected between the resistor element R112 and a base of the transistor Tr114. The transistor Tr114 has a collector connected to the node 110, an emitter connected to the node 108, and the base connected to the capacitor element C113.

The BGR 102 is connected between the node 108 and a ground (GND) terminal, and a constant voltage output terminal of the BGR 102 is connected to an internal circuit of a semiconductor integrated circuit (not shown) and to a base of the transistor Tr103. Further, the BGR 102 operates as a constant current consumption circuit after being started. In this case, it is desirable that a voltage at the node 108 reach a predetermined voltage value (5 V, for example) for starting the BGR 102 at the earliest possible time after the power supply voltage begins to rise. For this reason, when operations of the BGR 102 are completed (when the node 108 reaches a predetermined value) by a starting circuit provided in the BGR 102, a consumption current of the starting circuit is controlled to be reduced to nearly 0 A, whereby a reduction in required current is achieved.

The transistor Tr103 has a collector connected to the VREG 104, the base connected to a current mirror source provided in the BGR 102, and an emitter connected to the GND terminal. To obtain a desired current, the size of the emitter is adjusted according to an emitter size ratio of a transistor serving as the current mirror source. Accordingly, since the transistor Tr103 is connected to the BGR 102, the transistor Tr103 functions as a constant current source. The VREG 104 is connected between the power supply voltage terminal 107 and the collector of the transistor Tr103, and the constant voltage output terminal of the VREG 104 is connected to the base of the transistor Tr105.

In this case, a current flowing through the resistor element R101 is represented as I101, and an emitter current of the transistor Tr105 is represented as I105. Further, a source current of the transistor Tr106 is represented as I106, and an emitter current of the transistor Tr114 is represented as I114.

Figure 2:
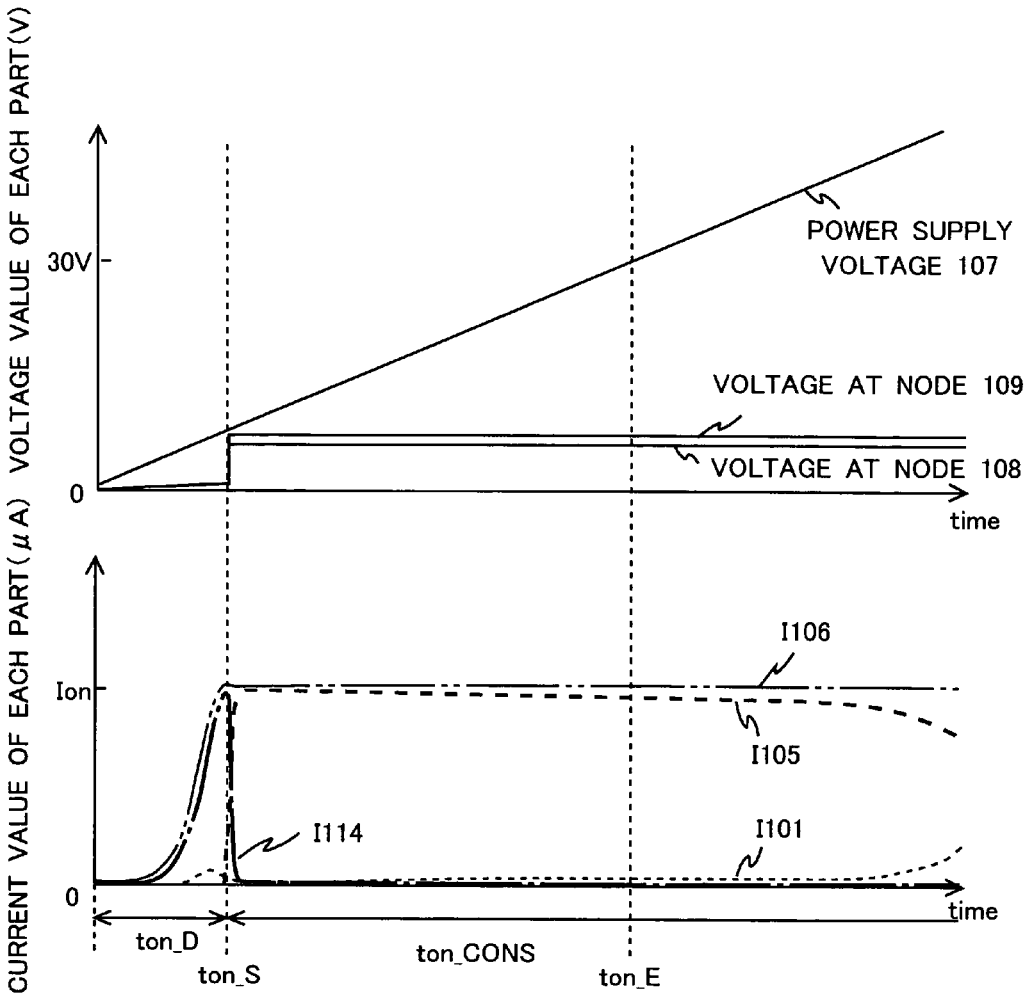
FIG. 2 shows an operation waveform of the bias circuit according to the embodiment of the present invention.

FIG. 2 shows an operation waveform of the bias circuit 10 shown in FIG. 1. Hereinafter, operations of the bias circuit 10 shown in FIG. 1 will be described with reference to FIG. 2.

A voltage at the power supply voltage terminal 107 (hereinafter, referred to as "power supply voltage 107") increases from 0 V to a final voltage (30 V, for example) with time. First, a time period ton_D between a time 0 and a time ton_S corresponds to a time period during which a current is supplied until starting of BGR 102 is completed. During the time period ton_D between the time 0 and the time ton_S, the current I101 flowing through the resistor element R101 is increasing. However, the current I101 is smaller than a consumption current Ion which is required for the BGR 102 to start, and the BGR 102 is in a process of being started. During the process, since the emitter current I105 of the transistor Tr105 does not flow, only the resistor element R101 serves as a current path leading to the BGR 102.

As the power supply voltage 107 increases, at a certain time at the beginning of the increase in current supply to the resistor element R101, that is, at a certain time at the beginning of the time period ton_D, a current is caused to flow to the base of the transistor Tr114 due to a charging operation from the power supply voltage 107 to the capacitor element C113 through the resistor element R112. As a result, the transistor Tr114 is turned on, and most of the current is supplied to the BGR 102 as the emitter current I114 of the transistor Tr114 in a short period of time. In this case, the time period ton_D, that is, the time period between the time when the power supply voltage 107 is set to 0 V and the time ton_S when the starting of the BGR 102 is completed, can be set using a CR-time constant according to a resistance value of the resistor element R112 and a capacitance value of the capacitor element C113. This means that a time for starting the BGR 102 can be adjusted independently of a change amount of the current I101 flowing through the resistor element R101.

At the time ton_S, the amount of the currents I101 and I114 supplied through the resistor element R101 and the transistor Tr114 reaches a consumption current amount necessary for completing the starting of the BGR 102. In this case, when the charging to the capacitor element C113 is completed according to the CR-time constant time, the transistor Tr114 is turned off to stop functioning as a bypass for supplying a current to the resistor element R101 in a process of supplying the current to the BGR 102. After that, the transistor Tr114 remains off irrespective of the increase of the power supply voltage 107, and is disabled.

When the starting of the BGR 102 is completed, the BGR 102 performs a constant current operation, whereby the consumption current is kept constant. In this case, the transistor Tr103 has the base connected to the current mirror source provided in the BGR 102, and the transistor Tr103 also performs the constant current operation. As a result, the node 109 is kept at a constant voltage due to the constant voltage operation of the VREG 104, and the transistor Tr105 is turned on. In this case, also the node 108 at the voltage supply point of the BGR 102 is kept at the constant voltage due to a unique voltage drop which corresponds to a base-emitter voltage (0.7 V, for example) of the transistor Tr105.

In addition, the BGR 102 operates as a constant current consumption circuit from the point of time. In this case, the current supply to the BGR 102 through the current path 111 is performed mainly using the collector-emitter current I105 caused to flow when the transistor Tr105 is turned on. The current I101 hardly flows through the resistor element R101 due to a resistance division ratio between an on-resistance component between the collector and the emitter of the transistor Tr105, and the resistor element R101.

Accordingly, during a time period ton_CONS between the execution of the operation at the time ton_S and the time when the final voltage (30 V, for example) of the power supply voltage 107 is obtained, the nodes 108 and 109 continuously perform the constant voltage operation. Accordingly, the constant current operation of the BGR 102 is also stabilized. At the same time, a supply current, which is the source-drain current I106 of the transistor Tr106 in the current path 111, is also stabilized. As a result, a current mirror operation of the transistor Tr106 and the transistor of the internal circuit of the semiconductor integrated circuit (not shown) enables the bias circuit 10 to perform a stable constant current bias operation for the internal circuit of the integrated circuit.

Figure 4:
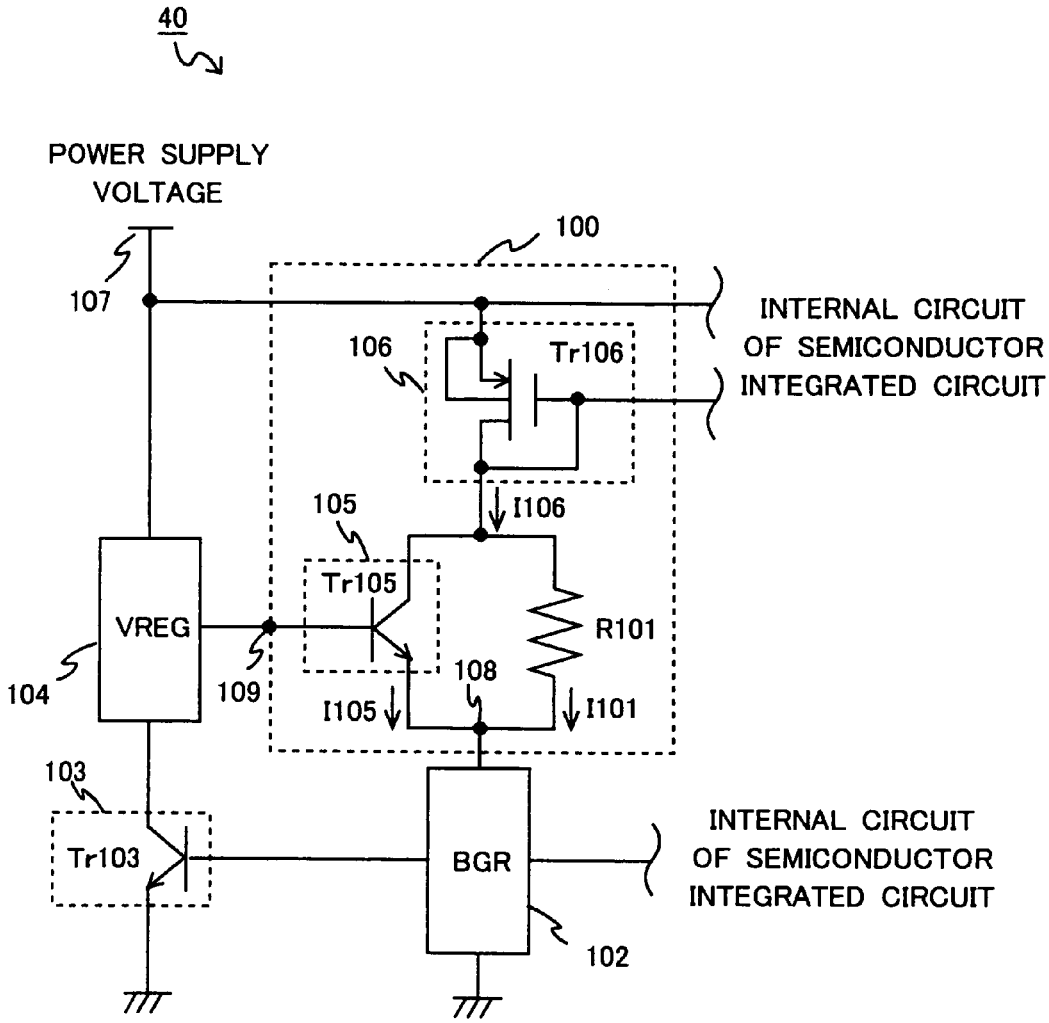
(RELATED ART) Fig. 4
FIG. 4 shows a bias circuit of a related art.
Figure 5:
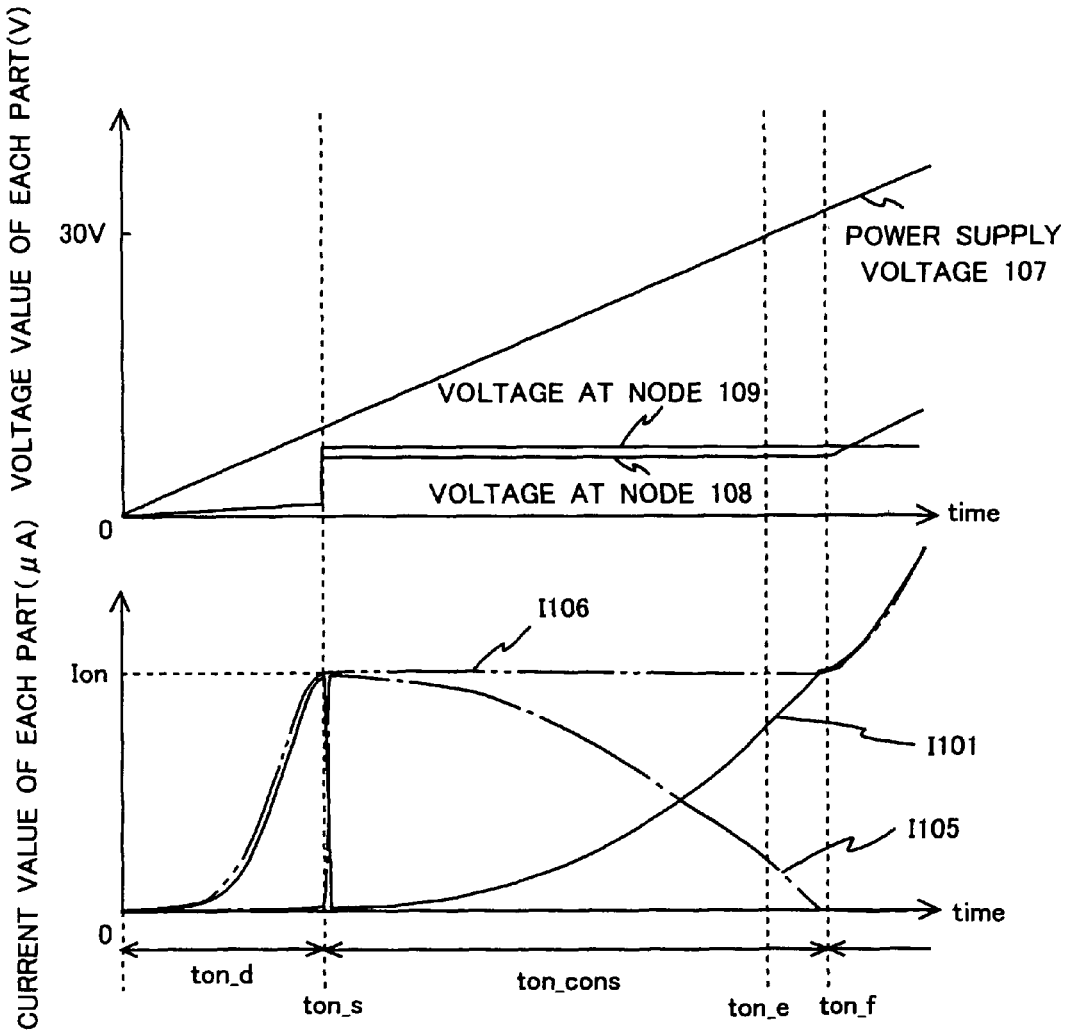
(RELATED ART) Fig. 5
FIG. 5 shows an operation waveform of the bias circuit of the related art.

Further, also during the time period ton_CONS, as the voltage across both ends (between nodes 110 and 108) of the resistor element R101 increases, accompanying the increase of the power supply voltage 107, the current I101 flowing through the resistor element R101 increases. Since the BGR 102 performs the constant current consumption operation, contrary to the increase of the current I101, accompanying the increase of the power supply voltage, the current I105 flowing through the transistor Tr105 decreases. However, if the final voltage exceeds 30 V, and further increases to, for example, 40 V, an increased amount of the current can be reduced by setting the resistance value of the resistor element R101 to a large value. Accordingly, by setting the resistance value of the resistor element R101 to a large value, the current I101 increases, accompanying the increase of the power supply voltage, whereby the final voltage of the power supply voltage 107 necessary for the current I105 to be reduced to 0 A can be set larger. As a result, it is possible to solve the problems as described in the example of the related art of FIGS. 4 and 5 in that, when the power supply voltage 107 increases, the transistor Tr105 is turned off (emitter current I105 becomes 0) at the time ton_f and the node 108 becomes incapable of performing the constant voltage operation. This means that the problems of the related art, that is, the following problems can be easily solved by adjusting the resistance value of the resistor element R101. That is, the problems in that: the current I101 flowing through the resistor element R101 continues to increase after the time ton_f; the supply current to the BGR 102 increases; the node 108 is not kept at the constant voltage; the consumption current of the BGR 102 is shifted from the constant current operation to a fluctuation operation; and the bias circuit becomes unstable when the power supply voltage fluctuates.

Further, for the following reasons, it is possible to solve the problems of the related art in that a current supply period (time period ton_d) for starting the BGR 102 becomes longer due to the operation for reducing the current amount and the current change amount of the current I101 when the resistance value of the resistor element R101 is set as large as possible. In the operation executed during the time period ton_D between the time 0 and the time ton_S, the current I101 flowing through the resistor element R101 serving as the current supply path leading to the BGR 102 is reduced. However, the transistor Tr114 is on for a time period according to the CR-time constant, and serves as a bypass current path for the transistor element R101. Accordingly, the current supply amount of the current I114 becomes larger than the current supply amount of the current I101, with the result that a start time for the BGR 102 to complete the starting operation can be reduced. Therefore, the time period to-n_D is shortened and the operation for stabilizing the bias circuit can be started earlier. In other words, the problems of the related art involving the stable operation of the bias circuit in a wide range of the applied voltage of the power supply voltage 107, and involving the reduction in time for stabilization of the starting operation, which are incompatible with each other, can be solved at the same time.

Figure 3:
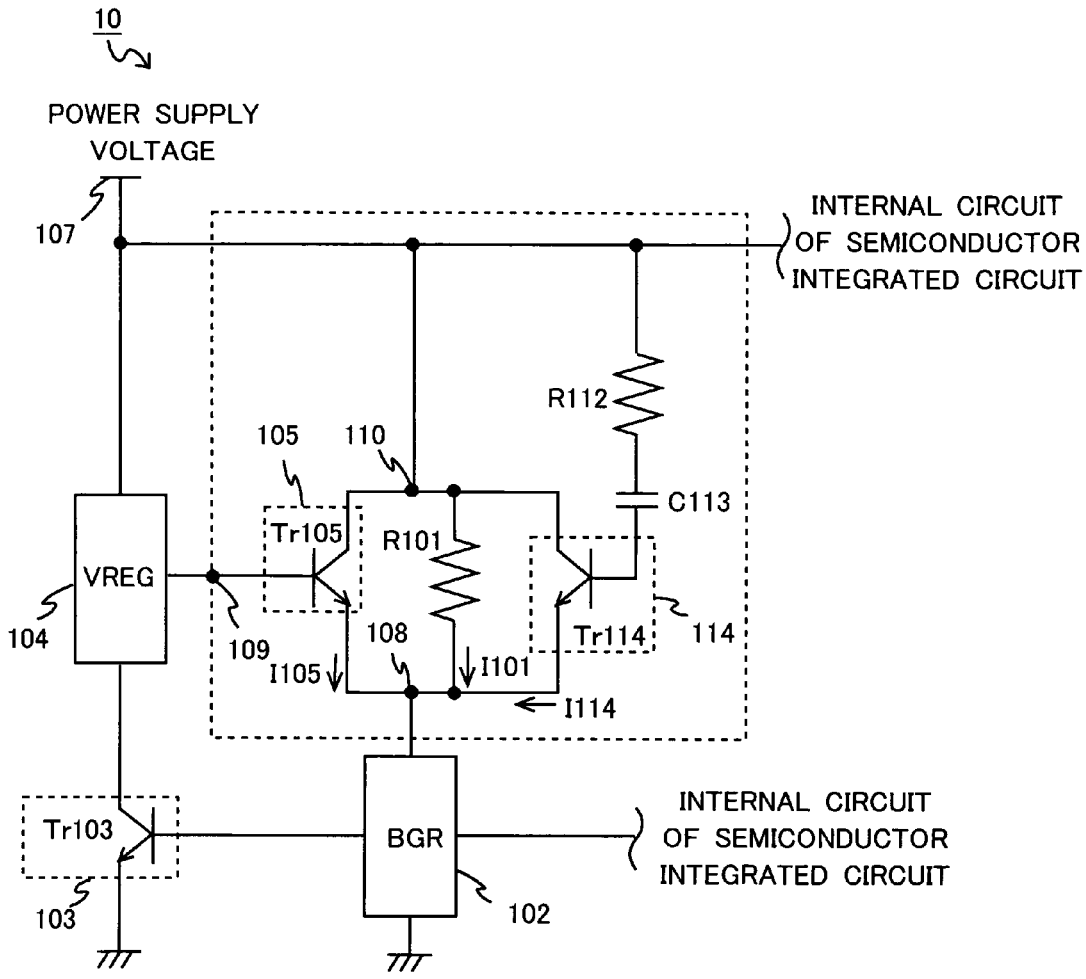
FIG. 3 shows a bias circuit according to another embodiment of the present invention.

Note that the present invention is not limited to the above embodiments, but may be appropriately modified without departing from the scope of the present invention. For example, as shown in FIG. 3, there may be employed the configuration in which the device 106 (PMOS transistor Tr106) is removed, the power supply voltage terminal 107 and the resistor element R101 are directly connected each other, and the collector of the device 114 (bipolar NPN transistor Tr114) and the collector of the device 105 (bipolar NPN transistor Tr105) are directly connected to each other. Operations and effects of the circuit shown in FIG. 3 are similar to those of the circuit shown in FIG. 1, so description thereof is omitted. Note that, in the circuit shown in FIG. 3, since the device 106 is removed, the constant current supply operation for the internal circuit of the semiconductor integrated circuit connected through the device 106 cannot be performed, with the result that only the constant voltage supply from the BGR 102 is performed. However, there is no voltage drop between the source and the drain of the device 106, so an applied voltage starting point for the starting operation during the increase of the power supply voltage 107 becomes lower. As a result, it is possible to set the starting voltage lower by that amount.

It is apparent that the present invention is not limited to the above embodiments, but may be modified and changed without departing from the scope and spirit of the invention.

What is claimed is

1. A bias circuit having a bandgap reference, comprising:

a first current path supplying a drive current to the bandgap reference; and a second current path supplying a current to the bandgap reference for a predetermined period of time after power-on, wherein the first current path comprises a first resistor element.

2. The bias circuit according to claim 1, wherein the second current path is connected in parallel with the first current path, and the second current path serves as a bypass current path for the first current path for the predetermined period of time.

3. The bias circuit according to claim 1, wherein the first current path further comprises a first transistor having an on-resistance smaller than a resistance value of the first resistor element, the first transistor being connected in parallel with the first resistor element.

4. The bias circuit according to claim 1, wherein the second current path comprises a second transistor having an on-resistance smaller than a resistance value of the first resistor element.

5. The bias circuit according to claim 4, wherein the predetermined period of time is determined according to a second resistor element and a capacitor element that are connected between a control terminal of the second transistor and a power supply.

6. The bias circuit according to claim 3, wherein the first transistor supplies a drive current to the bandgap reference after the predetermined period of time.

7. The bias circuit according to claim 1, wherein said predetermined period of time substantially corresponds to a startup period of said bandgap reference.

8. A bias circuit, comprising:

a bandgap reference circuit;

a first current path supplying a drive current to the bandgap reference circuit; and a second current path in parallel to said first current path, said second current path supplying additional startup current to the bandgap reference circuit for a predetermined period of time after a power-on, wherein said first current path comprises a drive current resistor in parallel with a transistor controlled by a voltage regulator circuit.

9. The bias circuit of claim 8, wherein said predetermined period of time substantially corresponds to a startup time of said bandgap reference circuit.

10. The bias circuit of claim 8, wherein said second current path comprises a startup transistor controlled by a capacitor/resistor circuit, said capacitor/resistor circuit conducting current substantially only during said power-on.

11. The bias circuit of claim 10, wherein sizes of said capacitor and resistor in said capacitor/resistor circuit are preselected to correspond to a startup time of said bandgap reference circuit.

12. The bias circuit of claim 8, wherein an impedance of said second current path during said power-on period is smaller than an impedance of said first current path.

13. A semiconductor integrated circuit, comprising:

an internal circuit;

a bandgap reference circuit providing a bias to said internal circuit; and a bias circuit for said bandgap reference circuit, wherein said bias circuit comprises:

a first current path supplying a drive current to the bandgap reference circuit; and a second current path in parallel to said first current path, said second current path supplying additional startup current to the bandgap reference circuit for a predetermined period of time after a power-on, and wherein said second current path comprises a startup transistor controlled by a capacitor/resistor circuit, said capacitor/resistor circuit conducting current substantially only during said power-on.

14. The semiconductor integrated circuit of claim 13, wherein said predetermined period of time substantially corresponds to a startup time of said bandgap reference circuit.

15. The semiconductor integrated circuit of claim 13, wherein an impedance of said second current path during said power-on period is smaller than an impedance of said first current path.

16. The semiconductor integrated circuit of claim 13, wherein said first current path comprises a drive current resistor in parallel with a transistor controlled by a voltage regulator circuit.

17. The semiconductor integrated circuit of claim 13, wherein sizes of said capacitor and resistor in said capacitor/resistor circuit are preselected to correspond to a startup time of said bandgap reference circuit.

* * * * *